US005482292A

United States Patent [19]

Stone

[11] Patent Number: 5,482,292

[45] Date of Patent: Jan. 9, 1996

[54] DUMPING TOY

[76] Inventor: Robert S. Stone, 20908 San Luis Ave., Woodland Hills, Calif. 91364

[21] Appl. No.: 380,834

[22] Filed: Jan. 30, 1995

[51] Int. Cl.[6] ..... A63B 63/00; F41J 5/00

[52] U.S. Cl. ..... 273/384

[58] Field of Search ..... 273/384

[56] References Cited

U.S. PATENT DOCUMENTS

| | | | |
|---|---|---|---|
| 1,021,019 | 3/1912 | Van Kannel | 273/384 |
| 1,413,770 | 4/1922 | Palaith | 273/384 |
| 1,671,000 | 5/1928 | Weinstein | 273/384 |
| 2,202,738 | 5/1940 | Keller | 273/384 |
| 4,093,228 | 6/1978 | Pierce | 273/384 |
| 4,466,616 | 8/1984 | Griego | 273/384 |
| 4,702,480 | 10/1987 | Popeski et al. | 273/384 |
| 4,943,064 | 7/1990 | Smith, Jr. | 273/384 |
| 5,087,054 | 2/1992 | O'Neil | 273/384 |

*Primary Examiner*—William H. Grieb
*Attorney, Agent, or Firm*—Kelly, Bauersfeld & Lowry

[57] ABSTRACT

A dumping toy that can safely and easily be used by one or more children includes a frame having a pivotable cross-beam that extends horizontally across an upper portion of the frame, and a receptacle flexibly connected to the cross-beam such that when a target connected to the cross-beam is stricken or falls over by a projectile, the otherwise upright receptacle tips over and dumps a selected material, for example water, onto a person under the receptacle and then automatically rights itself. The target may be a main target connected to the frame or it may be a remote target connected to either the main target or the frame.

29 Claims, 2 Drawing Sheets

DUMPING TOY

FIELD OF THE INVENTION

This invention relates generally to play yard equipment. More specifically, this invention relates to a dumping toy for use in a play yard or backyard.

BACKGROUND OF THE INVENTION

Dunking devices involve a player throwing an object at a target for the purpose of dropping a seat upon which a performer sits. When the target is hit, the performer falls into a tank containing water. Such a device is often found at carnivals and fund-raisers where the player pays so much per ball for the privilege of throwing at the target, with the chance of causing the performer to fall and get wet.

These types of dunking devices have been used for a long time. However, they are often expensive, require a large tank of water which is obtrusive in a yard and can be unsafe. They are usually further limited to just one player and one performer. They are also usually quite complicated in their construction and may cause severe injury if the performer is dropped by mistake against the tank rather than in the tank.

In recognition of these problems, water dumping devices involving dumping water on the performer (rather than dunking the performer into water) upon striking the target have been developed. U.S. Pat. No. 4,702,480 to Popeski describes a target connected through a lever arm to a water reservoir, which is configured to look like a toilet tank. Water is flushed onto the performer from the toilet tank. U.S. Pat. No. 4,093,228 to Pierce describes a water dumping toy using a lanyard assembly. None of these prior devices are easily adapted for play yard use.

Accordingly, there has been a need for a novel dumping toy structure which is fun, of simplified construction, inexpensive to manufacture, and easy to be safely used and operated by children. Such a toy is also needed which is easy to assemble and capable of disassembly into easily-stored components. Additionally, a dumping toy is needed which can be used by one or more children at the same time. The present invention fulfills these needs and provides other related advantages.

SUMMARY OF THE INVENTION

The present invention resides in a fun dumping toy that can be used in a backyard by one or more people. The toy is easy to operate and use, particularly by children. The toy comprises, generally, a frame having a pivotable cross-beam, a receptacle filled with a selected material, for example water and flexibly connected to the cross-beam, and means for pivoting the cross-beam when a target connected to the cross-beam is struck by a projectile whereby the receptacle pivots from an upright position to a tipped position thereby dumping the selected material.

The frame is supported on the ground by foot portions. The frame includes first and second vertical posts and a trio of crossbars extending therebetween. A signboard spans the space between two of the three crossbars for structural stability and for bearing trademark or other information. The foot portions have a triangular-shaped base.

The receptacle is supported on a top surface of the cross-beam. The receptacle is flexibly connected to the cross-beam by an elastic member such as an elastic band. The receptacle is automatically returned to an upright position after the selected material has been dumped. The cross-beam is a square beam transversely extending from a round bore in the first vertical post to and through a substantially arcuate bore in the opposite second vertical post. A first end of the cross-beam has a dowel that is received in the round bore in the first vertical post. A second end of the cross-beam terminates in a main target arm that extends downwardly at a right angle. The main target arm is removably connected to the cross-beam by a pair of U-shaped brackets. The cross-beam has a reduced cross-section portion at the point it passes through the substantially arcuate bore.

The target may be a main target or a remote target both having conventional round flat discs marked with concentric circles and a bull's eye. For the main target, the discs are mounted on a triangular-shaped base. The base is oriented perpendicular to and at the lower end of the main target arm. A pair of screw eyes are mounted in the underside of the triangular base. For the remote target, the discs are mounted at an upper end of a stand. The remote targets are spaced apart from the frame, but in substantially the same line of trajectory as the main target. The stand includes a pedestal having a single erect post extending upwardly therefrom. The post terminates at its upper end into an inverted T-shaped support. The discs are mounted on either side of the support. A rope extends from the stand and has at its free end a clasp. If one remote target is used, the clasp is hooked to a screw eye in an upright post on the frame between the main target arm and second vertical post. If two remote targets are used, each of the clasps is hooked to the closest screw eye on the main target arm base.

When the main target is struck, the main target arm swings rearwardly causing the cross-beam to pivot forwardly to dump the selected material. When the remote target connected to the screw eye in the upright post is struck, the remote target falls so that the upright post will pivot forwardly in the same direction as the fallen target causing the cross-beam to pivot forwardly dumping the selected material. When the remote targets are connected to the screw eyes on the main target arm, the main target arm will swing in the same direction as the fallen remote target, causing the cross-beam to pivot rearwardly to tip the receptacle and dump the selected material.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
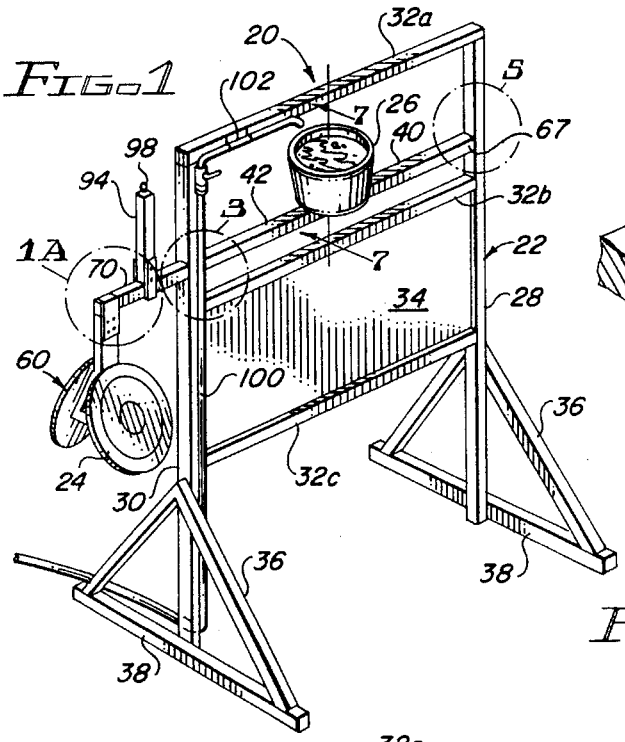
FIG. 1 is a perspective view of a dumping toy embodying the invention, illustrating the toy in an unactuated state with an upright receptacle filled with water supported on a cross-beam extending between and through a pair of vertical posts of a frame, a main target arm in a vertical orientation, and a main target having a pair of target discs at the lower end of the main target arm.
Figure 3:
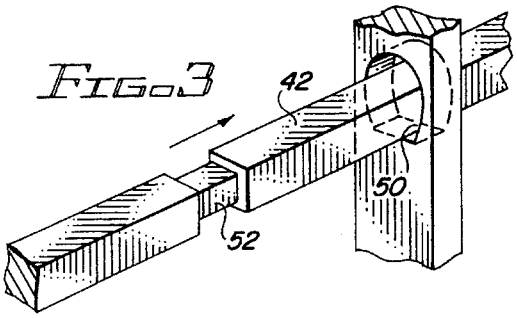
FIG. 3 is an enlarged assembly view corresponding with the encircled region 3 of FIG. 1, illustrating a portion of the cross-beam having a reduced cross-section being received in a substantially arcuate bore with a flat bottom surface in one of the vertical posts.

As shown in the drawings for purposes of illustration, the present invention is concerned with a dumping toy used for amusement, generally designated in the accompanying drawings by the reference number 20. The device comprises, generally, a frame 22 that is supported on the ground, at least one target 24 connected to the frame 22 that when struck causes a receptacle 26 filled with water to pivot from an upright position to a tipped position thereby dumping the water on any object that has been placed therebelow.

The frame 22 has vertical posts 28 and 30 extending to the ground and a trio of parallel crossbars 32*a, b,* and *c* extending therebetween. The first crossbar 32*a* extends on top of and between the top ends of the vertical posts 28 and 30. The second crossbar 32*b* is approximately one-quarter of the way down the vertical posts 28 and 30. The third crossbar 32*c* is slightly more than one-half down the vertical posts 28 and 30. A signboard 34 spans the space between the second and third crossbars 32*b* and 32*c*. The signboard 34 adds structural stability and can bear a sign or notice, for example, the trademark for the dumping toy. At the lower end of each of the two vertical posts 28 and 30 are foot portions 36 for supporting the toy on the ground. The foot portions 36 are constructed from short pieces of wood configured to be triangular shaped, with a base 38 of the triangle on the ground. The base 38 of the triangle extends laterally beyond the two sides thereof providing even greater frame stability. The triangle apexes are centered on the respective vertical posts 28 and 30.

Figure 4A:
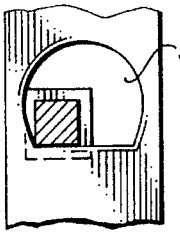
FIGS. 4A and 4B are enlarged, fragmented, partially sectional views of encircled region 3 of FIG. 1, illustrating the cross-beam in the substantially arcuate bore and its pivoting around a noncentral axis.
Figure 4B:
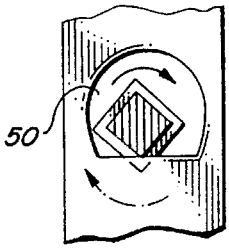

The receptacle 26 is supported on a top surface 40 of a cross-beam 42 of frame 22. The cross-beam 42 is a square beam transversely extending from vertical post 28 beyond and through the opposite vertical post 30 where it terminates in a separate main target arm 44. The cross-beam 42 has a rounded dowel 46 at a first end 47 starting at vertical post 28. The vertical posts are provided with bores 48 and 50 for receiving the cross-beam 42. Bore 48 is round to receive the dowel 46. Bore 50 is substantially arcuate with a flat bottom surface. The cross-beam 42 has a reduced cross-section portion 52 at the point it passes through the substantially arcuate bore with a flat bottom surface 50. The reduced cross-sectional portion 52 sits in the substantially arcuate bore with a flat bottom surface 50 to prevent the cross-beam from sliding out. The shape of bore 50 allows the cross-beam 42 to pivot easily. The cross-beam pivots on its sides as shown in FIGS. 4A and 4B.

The receptacle 26 is flexibly and rotatably connected to the top flat surface 40 of the cross-beam 42 by an elastic member such as a band 54. The elastic band 54 is fitted through an opening (not shown) in the cross-beam 42 and secured by waterproof glue and a cotter pin 56 on the inside bottom surface of the receptacle 26 and on a bottom surface of a cross-beam 58. This arrangement maintains the receptacle 26 in an upright position until the target 24 is struck and returns the receptacle 26 to an upright position after the water has been dumped and gravity pulls the main target arm and cross-beam back to their unactuated position.

Figure 1A:
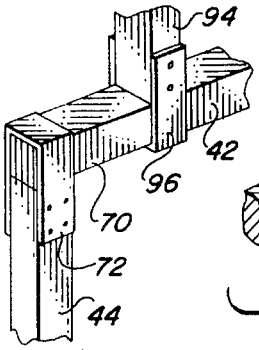
FIG. 1A is an enlarged, fragmented perspective view corresponding with the encircled region 1A of FIG. 1, illustrating the manner in which the main target arm and an upright post are connected to the cross-beam by U-shaped brackets.
Figure 5:
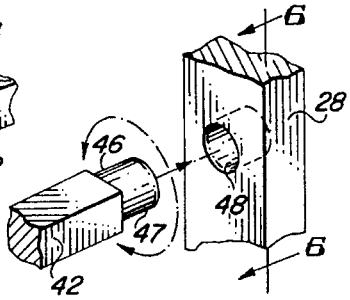
FIG. 5 is an exploded, enlarged fragmented view corresponding with encircled region 5 of FIG. 1, illustrating a dowel at one end of the cross-beam being received in a round bore in the other vertical post.
Figure 2:
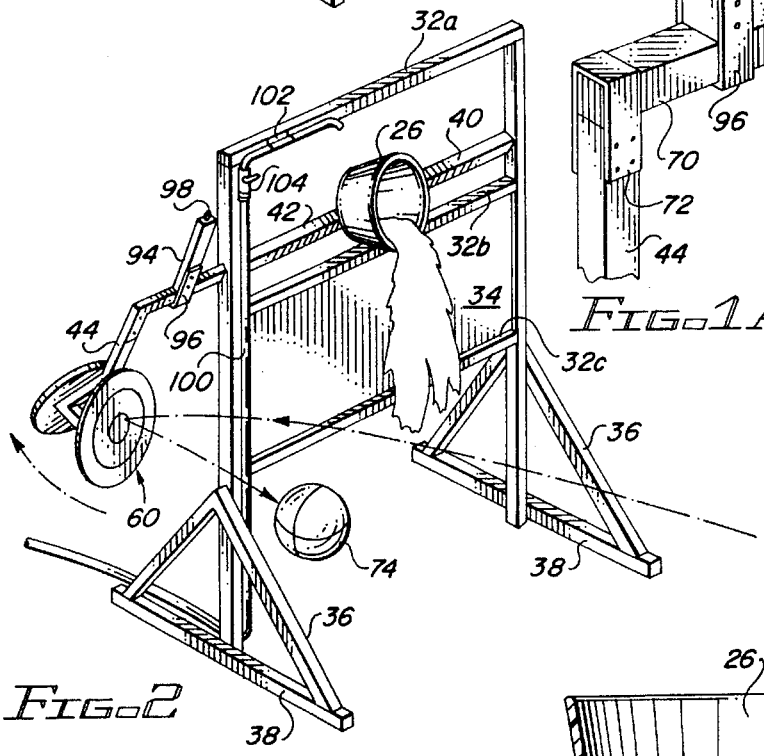
FIG. 2 is a perspective view of the dumping toy similar to FIG. 1, illustrating the toy in an actuated state with the main target arm swung rearwardly after the main target is struck by a projectile thereby causing the cross-beam to pivot tipping the receptacle in a forward and downward movement thereby dumping the water.
Figure 6:
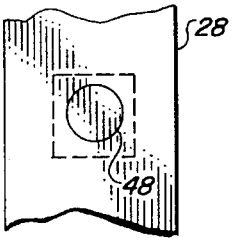
FIG. 6 is an enlarged, fragmented elevational view of the dowel received in the vertical post taken along the line 6—6 of FIG. 5.
Figure 7:
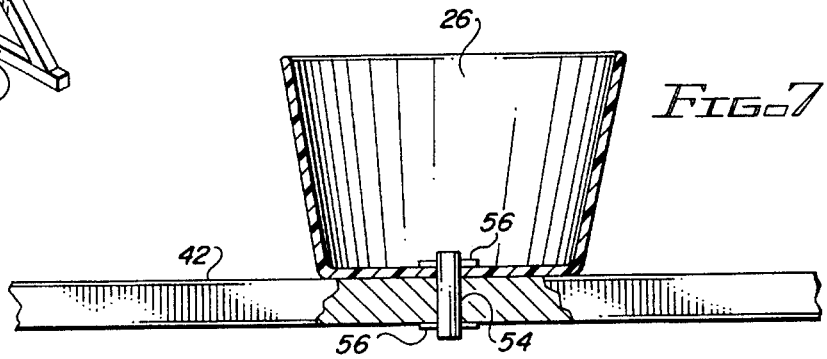
FIG. 7 is an enlarged, fragmented and partially sectional view of the receptacle supported in an upright position on the cross-beam by an elastic member, taken generally along the line 7—7 of FIG. 1.
Figure 8A:
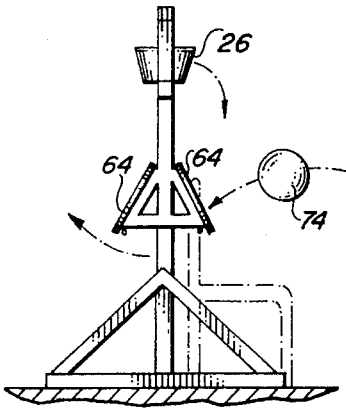
FIG. 8A is an end view of the water dumping toy of FIG. 1 showing the main target struck by an exemplary ball, wherein the arrows represent rearward movement of the main target arm causing forward and downward movement of the receptacle.
Figure 10:
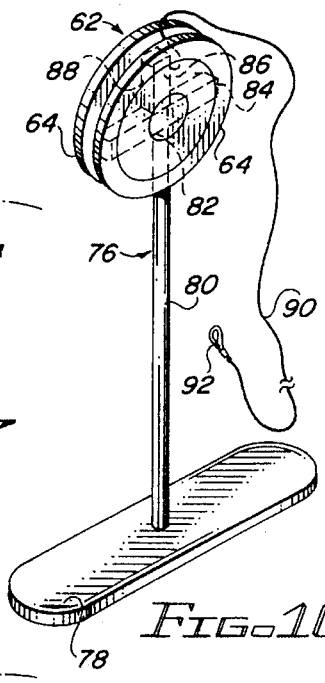
FIG. 10 is a perspective view of a remote target, illustrating the target discs mounted on a stand and a rope having a first end connected thereto and a second free end terminating in a clasp.
Figure 9:
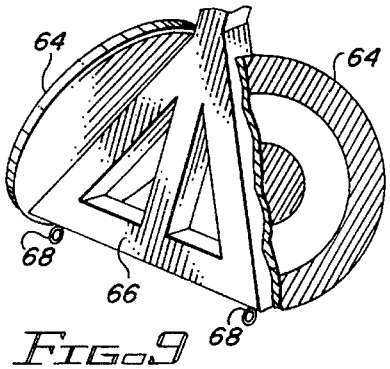
FIG. 9 is a partially fragmented, perspective view of the main target, illustrating the target discs mounted on a triangular shaped base at the lower end of the main target arm, wherein part of one of the discs is broken away to expose the base and a pair of screw eyes mounted into the underside of the base.
Figure 11:
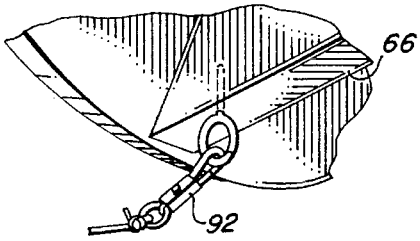
FIG. 11 is a perspective view of the remote target clasp hooked to one of the screw eyes on the main target base.
Figure 8B:
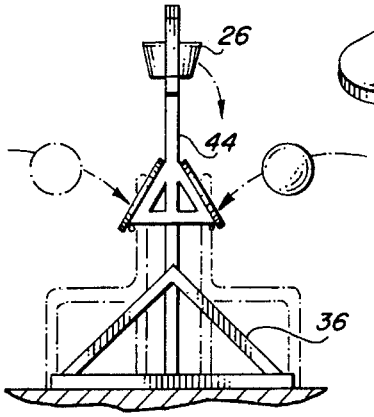
FIG. 8B is another end view similar to FIG. 8A, illustrating the ability of either disc of the main target to be struck causing the receptacle to tip in either direction.

The target 24 may be a main target 60 or a remote target 62. Both the main and remote targets 60 and 62 have conventional round flat discs 64 marked with concentric circles and a bull's eye. FIG. 1 includes an illustration of a main target 60. The discs 64 are mounted on a triangular shaped base 66 oriented perpendicular to the main target arm 44 at the lower end thereof. The target discs 64 are mounted diagonally on the angle sides of the base 66 with the concentric circles and bull's eye facing outwardly. The base 66 provides additional surface area and thus support for the main target 60. There are a pair of screw eyes 68 mounted int the underside of either side of the triangular base, the purpose for which will be described hereinafter. The main target arm 44 extends downwardly at a right angle from a second end of the cross-beam 70. As shown best in FIG. 1A, the arm 44 is removably connected to the cross-beam 42 by a pair of U-shaped brackets 72. The brackets 72 permit the target arm 44 to be slid off the cross-beam 42 when disassembly is desired. The brackets are, however, closely sized to the cross-beam to prevent slippage when the device is in use.

Figure 12A:
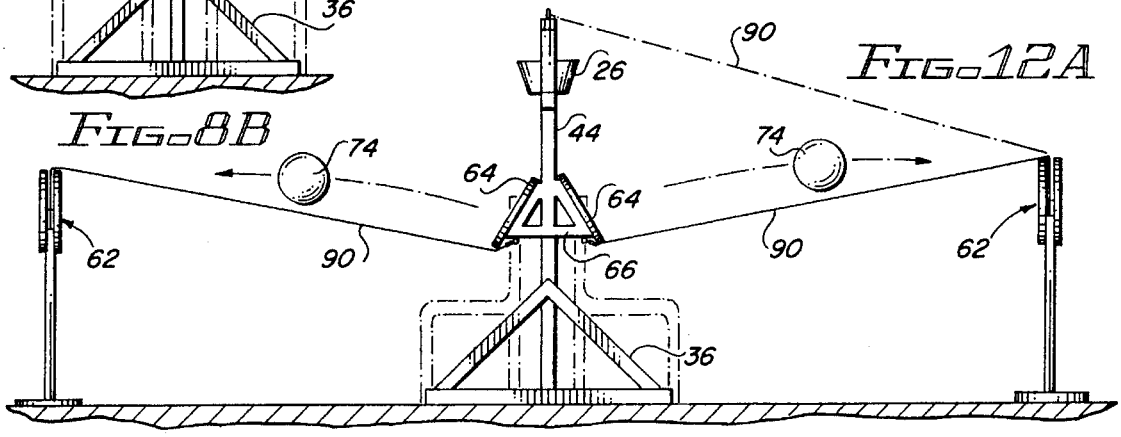
FIG. 12A is an end view of the dumping toy illustrating use of the remote target, the solid lines indicating connection of two remote targets to respective screw eyes in-the underside of the main target base and the dotted-dash line indicating alternative connection of one remote target to an upright post of the frame.
Figure 12B:
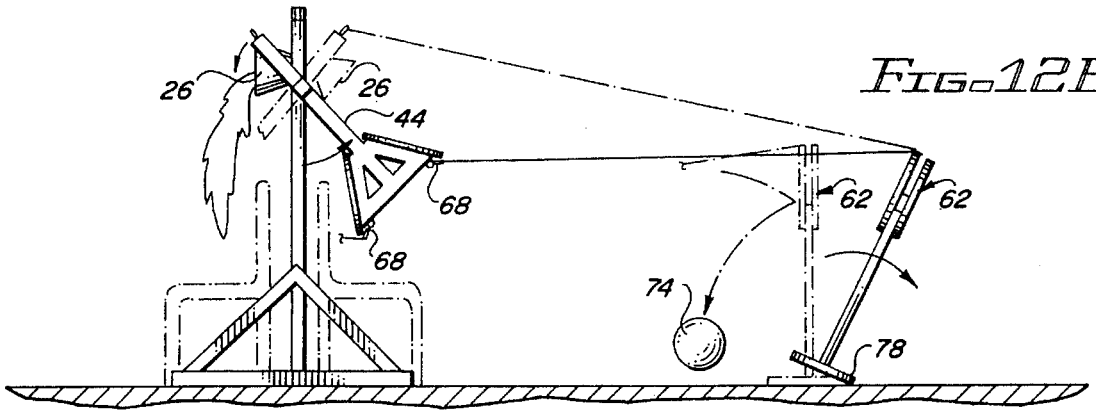
FIG. 12B is an end view of the dumping toy of FIG. 12A, illustrating the movement of the main target arm and upright post toward the falling remote target, the cross-beam and receptacle pivoting rearwardly with movement of the main target arm and forwardly with movement of the upright post.

In FIGS. 12A and 12B, at least one remote target 62 is spaced apart from the frame, but substantially (up to 75 degrees left or right of the line of trajectory) in the same line of trajectory as the main target 60. For each remote target, the conventional target discs 64 are mounted flat on either side at the upper end of a stand 76, the concentric circles and bull's eye facing outwardly on both sides. The stand 76 includes an oblong pedestal 78. Extending upwardly of the pedestal 78 is a single erect post 80 which terminates at its upper end into an inverted T-shaped support 82. Each disc 64 is mounted to opposite sides of the support 82. The support 82 includes a square horizontal cross-piece 84 and a vertical square post 86 perpendicular thereto. There is a bore 88 extending transversely through the vertical square post 86. A rope 90 having a knot (not shown) at a first end is fed through the bore 88 such that the knot prevents the rope 90 from slipping through the bore 88. There is a clasp 92 at a second end of the rope 90. The clasp 92 has a retractable thumb piece. This type of clasp is safer for children than other types which may pinch a child. When the remote target 62 is not in use, the rope 90 may be wrapped around the support 82 keeping it and the clasp 92 out of the way and concealed between the target discs 64.

A short upright post 94 is connected by a bracket 96 to the cross-beam 42 between vertical post 30 and the main target arm 44. A screw eye 98 is fastened into the top of the post 94, the purpose for which will be described later. The upright post bracket 96 is closely sized to the cross-beam so as to prevent slippage but yet allowing the upright post 94 to be slid on and off the cross-beam 42.

Attached to and extending longitudinally along the vertical post 30 is a water supply hose 100 having a hose connection (not shown) at the lower end and its upper end bent downwardly to form an outlet for directing the flow of water into the receptacle 26. The water supply hose 100 is held against the first crossbar 32*a* by a fastener 102. A valve 104 near the upper end of the water supply hose 100 permits the water to be turned off and on as needed. The receptacle can be quickly filled with water.

In operation, a player attempts to impact the target 24 with the projectile 74, such as a soft ball, from a distance. The dumping toy may be used in several different ways. The traditional way is to have one or more children seated to one side of the receptacle 26 and one or more children throwing the projectile 74 at the disc 64 of the main target 60 on the same side of the frame 22 that the children are sitting on. An additional ay to play is to have one or more children sitting on both sides of the receptacle and one or more children throwing at both discs of the main target arms. When the main target is struck, it is forced rearwardly, resulting in a swing of the main target arm 44 in a rearward direction, the cross-beam pivoting forwardly toward the thrower and the weight of the water and gravity extending the elastic band 54 and causing the receptacle 26 to tip over almost 90 degrees irrespective of the angle of the main target arm. Water from the receptacle 26 then douses the child or children sitting under the tipped receptacle. The receptacle automatically rights itself because once the water is dumped, the force of gravity pulls the main target to its unactuated position, thereby also returning the cross-beam to its unactuated position. This combined with the force of the fully extended elastic band 54 pulling the now empty receptacle returns the receptacle to an upright position. The receptacle can tip toward either side depending on which disc 64 of the main target 60 is impacted.

Another way to play is to set up the remote targets 62. When in use, the rope 90 is extended to the desired length. The rope for each remote target may be extended to a length different from each other in order to accommodate players of different skill levels. Each clasp 92 is fastened to the closest screw eye 68 on the main target base 66 or to the upright post screw eye 98 depending on which game is to be played, as will be described hereinafter. If the clasps 92 are attached to the screw eyes 68 located at the underside of the main target base 66, two children may play against each other. They each sit in a chair under (to each side of) the receptacle facing away from the frame 22. They aim at their respective remote target 62 and throw the projectile 74. When the first child strikes his remote target 62 and knocks it over, the rope 90 pulls the main target arm 44 toward the fallen remote target 62 forcing the cross-beam 42 to pivot rearwardly, dumping water onto his opponent.

One can also play by oneself by using one of the remote targets. In this game, shown in dotted and dashed lines in FIG. 12B, the remote target rope 90 is attached to the screw eye 98 located at the top end of the upright post 94. The child sits in a chair on the same side as the remote target, takes aim, and throws the projectile 74 at the remote target 62. When the remote target is struck and knocked over, the upright post 94 is pulled toward the stricken target causing the receptacle to tip forwardly dousing water onto the seated child. Of course, these games can be played with more than one child and in any variation of this theme.

It will be appreciated that the device may be made of any suitable material such as plastic, even though the description above has been directed to wood. The material can be of a conventional material used for childrens' outdoor play equipment. It must be able to withstand the wear and tear of playing children as well as relatively constant exposure to water and the outdoor elements. The receptacle may be filled with water or any other selected material. Examples include Jello®, balls, etc.

During the colder months when water play usually comes to a halt, the dumping toy 20 may be disassembled for storage. The receptacle 26 can be removed with the elastic band 54 by undoing the cotter pin 56 on the bottom surface of the cross-beam. The target arm 44 and upright post 94 may be removed by sliding the respective brackets 72 and 96 off the cross-beam 42. The cross-beam 42 may be removed by sliding it through the substantially arcuate bore with the flat bottom surface 50. It will be appreciated that the targets and frame may also be disassembled by using removable fasteners such as are well known in the art.

Although a particular embodiment of the invention has been described in detail for purposes of illustration, various modifications may be made without departing from the spirit and scope of the invention. Accordingly, the invention is not to be limited, except as by the appended claims.

What is claimed is:

1. A toy for dumping a selected material, for example water, comprising:

a frame having a pivotable cross-beam;

a receptacle flexibly connected to the cross-beam, the receptacle filled with the selected material; and a target connected to the cross-beam such that when struck by a projectile, the receptacle pivots form an upright position to a tipped position thereby dumping the selected material.

2. The dumping toy of claim 1, further comprising means for flexibly connecting the receptacle to the cross-beam.

3. The dumping toy of claim 2, wherein the flexible connection means includes an elastic band.

4. The dumping toy of claim 1, wherein the target comprises a main target that is connected to the cross-beam by a main target arm extending downwardly from one end of the cross-beam.

5. The dumping toy of claim 4, wherein the main target has a pair of target discs mounted facing outwardly on the angled sides of a triangular shaped base at a lower end of the main target arm.

6. The dumping toy of claim 5, wherein the target comprises a remote target that is connected to the cross-beam by a rope extending form the remote target to the main target arm, the rope having a clasp at a free end thereof to fasten to the closest one of a pair of screw eyes mounted into the underside of the triangular shaped base of the main target arm.

7. The dumping toy of claim 1, wherein the target comprises a remote target that is connected to the cross-beam by a rope extending from the remote target having a clasp at a free end of the rope to fasten to a screw eye at the top end of an upright post connected to the cross-beam between the main target arm and one of a pair of vertical posts of the frame.

8. The dumping toy of claim 6, wherein the remote target has a pair of target discs mounted on an upright stand, the stand including a single erect post extending upwardly of a pedestal and terminating at its upper end in an inverted T-shaped support having a square horizontal cross-piece and a vertical square post with a bore extending transversely therein for receiving the end of the rope.

9. The dumping toy of claim 7, wherein the remote target has a pair of target discs mounted on an upright stand, the stand including a single erect post extending upwardly of a pedestal and terminating at its upper end in a inverted T-shaped support having a square horizontal cross-piece and a vertical square post with a bore extending transversely therein for receiving the end of the rope.

10. The dumping toy of claim 6, wherein a pair of the remote targets are placed on either side of the frame but in substantially the same line of trajectory as the main target discs, each of the remote targets connected to their respective screw eye on the main target base.

11. The dumping toy of claim 2, wherein the flexible connection means automatically returns the receptacle to an upright position after dumping the selected material.

12. The dumping toy of claim 4, wherein the main target arm swings rearwardly causing the cross-beam to pivot forwardly thereby dumping the selected material.

13. The dumping toy of claim 6, wherein the main target arm swings forwardly when the remote target is knocked over by a projectile causing the cross-beam to pivot rearwardly thereby dumping the selected material.

14. The dumping toy of claim 7, wherein the upright post swing forwardly when the remote target is knocked over by a projectile causing the cross-beam to pivot forwardly thereby dumping the selected material.

15. A toy for dumping a selected material, for example water, comprising:

a frame having a pivotable square cross-beam that extends horizontally across an upper portion of the frame;

an upright receptacle flexibly connected to the cross-beam and filled with the selected material; and a main target connected to the cross-beam by a main target arm extending downwardly from one end of the cross-beam such that when struck by a projectile, the target arm swing rearwardly causing the cross-beam to pivot forwardly and downwardly tipping the receptacle and thereby dumping the selected material.

16. The dumping toy of claim 15, wherein the cross-beam extends from a first vertical post of the frame through a second vertical post terminating in the main target arm.

17. The dumping toy of claim 15, wherein the cross-beam has a dowel at one end that is received in a round bore in the first vertical post.

18. The dumping toy of claim 15, wherein the cross-beam has a reduced cross-section portion that is placed in a substantially arcuate bore having a flat bottom surface in the second vertical post.

19. A toy for dumping a selected material, for example water, comprising:

a frame having a pair of first and second vertical posts, a trio of parallel crossbars extending therebetween, a signboard between two of the three crossbars, and a cross-beam extending horizontally across an upper portion of the frame from the first vertical post where a dowel at the end of the cross-beam is received in a round bore therein through and beyond a substantially arcuate bore having a flat bottom surface in the second vertical post, and a triangular foot portion at the lower end of each of the first and second vertical posts;

a receptacle filled with the selected material and supported on a flat upper surface of the cross-beam and connected thereto by an elastic band fitted through an opening in the cross-beam and secured thereto;

at least one target connected to the cross-beam, the target having a pair of target discs mounted on opposite sides thereof; and means for pivoting the cross-beam when the target is struck by a projectile whereby the receptacle pivots from an upright position to a tipped position thereby dumping the selected material.

20. The dumping toy of claim 19, wherein the cross-beam terminates in a separate main target arm extending downwardly at a right angle from the cross-beam, the target arm being removably connected to the cross-beam.

21. The dumping toy of claim 19, wherein a short upright post extends upwardly from the cross-beam just outboard of the second vertical post, the post connected to the cross-beam.

22. The dumping toy of claim 20, wherein the target comprises a main target and the target discs are mounted on the angled sides of a triangular shaped base at a lower end of the main target arm.

23. The dumping toy of claim 22, wherein the base has a pair of screw eyes mounted onto the underside thereof.

24. The dumping toy of claim 22, wherein the main target arm swings rearwardly when the main target is struck by the projectile whereby the cross-beam pivots forwardly to tip the receptacle.

25. The dumping toy of claim 23, wherein the target comprises a remote target that is connected to the cross-beam by a rope extending from the remote target to the main target arm, the rope having a clasp at a free end thereof to fasten to the closest one of the screw eyes mounted onto the underside of the base.

26. The dumping toy of claim 25, wherein the main target swings forwardly when the remote target is knocked over by a projectile causing the cross-beam to pivot rearwardly thereby dumping the selected material.

27. The dumping toy of claim 21, wherein the target comprises a remote target that is connected to the cross-beam by a rope extending from the remote target having a clasp at a free end of the rope to fasten to a screw eye at the top end of the upright post.

28. The dumping toy of claim 27, wherein the upright post swings forward when the remote target is knocked over by a projectile causing the cross-beam to pivot forwardly thereby dumping the water.

29. The dumping toy of claim 25, wherein a pair of the remote targets are placed on either side of the frame but in substantially the same line of trajectory as the main target discs, each of the remote targets being connected to their respective screw eye on the main target base.

* * * * *